US006959684B2

(12) United States Patent
Rayl

(10) Patent No.: US 6,959,684 B2
(45) Date of Patent: Nov. 1, 2005

(54) TORQUE BASED CYLINDER DEACTIVATION WITH VACUUM CORRECTION

(75) Inventor: Allen B. Rayl, Waterford, MI (US)

(73) Assignee: General Motors Corporation, Detroit, MI (US)

( * ) Notice: Subject to any disclaimer, the term of this patent is extended or adjusted under 35 U.S.C. 154(b) by 11 days.

(21) Appl. No.: 10/685,200

(22) Filed: Oct. 14, 2003

(65) Prior Publication Data

US 2005/0076882 A1 Apr. 14, 2005

(51) Int. Cl.[7] ..... F02D 17/02

(52) U.S. Cl. ..... 123/198 F

(58) Field of Search ..... 123/198 F, 481, 123/399

(56) References Cited

U.S. PATENT DOCUMENTS

| | | | |
|---|---|---|---|
| 5,270,935 A | 12/1993 | Dudek et al. | |
| 5,423,208 A | 6/1995 | Dudek et al. | |
| 5,465,617 A | 11/1995 | Dudek et al. | |
| 6,782,865 B2 * | 8/2004 | Rayl et al. | 123/198 F |

* cited by examiner

*Primary Examiner*—Tony M. Argenbright
*Assistant Examiner*—Hyder Ali
(74) *Attorney, Agent, or Firm*—Christopher DeVries

(57) ABSTRACT

An engine control system controls transitions between activated and deactivated modes in a displacement on demand engine. The engine control system includes an engine speed sensor that generates an engine speed signal and a controller that calculates a torque reserve of the engine based on the engine speed signal. The controller transitions the engine from the activated mode to the deactivated mode when the torque reserve is greater than a threshold torque. The controller transitions the engine from the deactivated mode to the activated mode when the torque reserve is lower than the threshold torque.

22 Claims, 2 Drawing Sheets

TORQUE BASED CYLINDER DEACTIVATION WITH VACUUM CORRECTION

FIELD OF THE INVENTION

The present invention relates to internal combustion engines, and more particularly to control systems that command transitions in a displacement on demand engine.

BACKGROUND OF THE INVENTION

Some internal combustion engines include engine control systems that deactivate cylinders under low load situations. For example, an eight cylinder can be operated using four cylinders to improve fuel economy by reducing pumping losses. This process is generally referred to as displacement on demand or DOD. Operation using all of the engine cylinders is referred to as an activated mode. A deactivated mode refers to operation using less than all of the cylinders of the engine (one or more cylinders not active).

To smoothly transition between the activated and deactivated modes, the internal combustion engine must produce sufficient drive torque with a minimum of disturbances. Otherwise, the transition will not be transparent to the driver. In other words, excess torque will cause engine surge and insufficient torque will cause engine sag, which degrades the driving experience.

Conventional engine control systems transition between the activated and deactivated modes based on engine vacuum, used as a surrogate for reserve torque, which is commonly referred to as vacuum-based moding. Vacuum-based moding can result in undesired cycling between modes at some ambient conditions. Additionally, transition lags from deactivated to activated modes may occur as a result of intake manifold filling delays, which could cause a slight delay in vehicle acceleration.

SUMMARY OF THE INVENTION

The present invention provides an engine control system for controlling transitions between activated and deactivated modes in a displacement on demand engine. The engine control system includes an engine speed sensor that generates an engine speed signal and a controller that calculates a torque reserve of the engine based on the engine speed signal. The controller transitions the engine from the activated mode to the deactivated mode when the torque reserve is greater than a threshold torque. The controller transitions the engine from the deactivated mode to the activated mode when the torque reserve is lower than the threshold torque.

In one feature, the controller determines available and desired brake torques. The torque reserve is based on a difference between the available brake torque and the desired brake torque at the current engine and atmospheric conditions.

In another feature, the available brake torque is based on atmospheric conditions, engine speed, estimated pumping losses of the engine, inlet charge dilution, estimated friction losses of the engine and tables or equations of engine efficiency. The desired brake torque is based on accelerator pedal position, engine speed, estimated pumping losses of the engine, estimated friction losses of the engine and estimated accessory drive loads.

In still another feature, the controller generates a torque error signal and adjusts the torque reserve based on the torque error signal. The torque error signal is based on a difference between a vacuum signal received by the controller and a model vacuum signal determined by the controller.

In another feature, the controller transitions from the deactivated mode to the activated mode when the torque reserve is lower than the threshold torque or the engine has insufficient vacuum.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
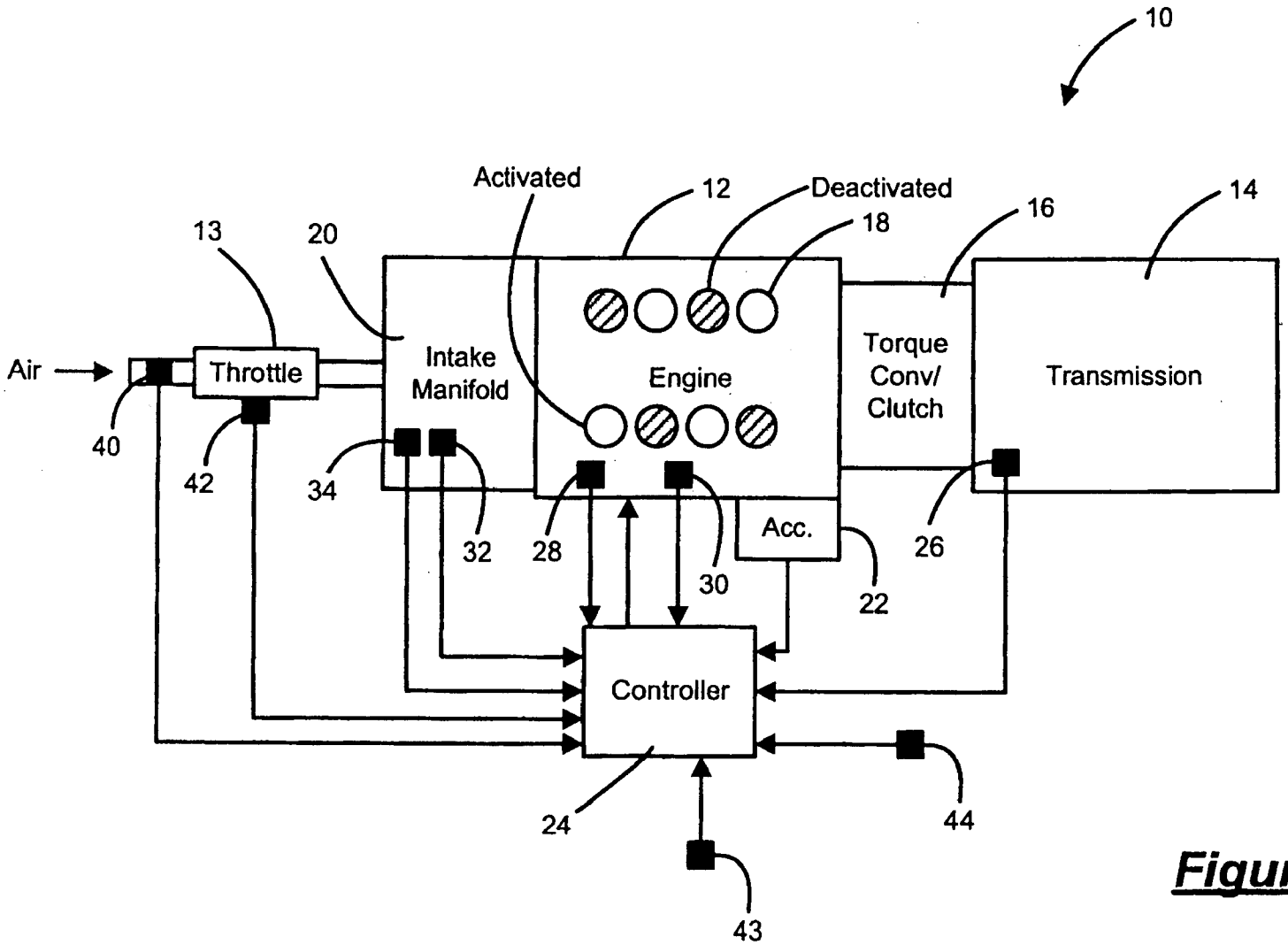
FIG. 1 is a functional block diagram illustrating a vehicle powertrain including a DOD transition control system that employs torque-based moding according to the present invention.

The following description of the preferred embodiment is merely exemplary in nature and is in no way intended to limit the invention, its application, or uses. For purposes of clarity, the same reference numbers will be used in the drawings to identify similar elements. As used herein, activated refers to operation using all of the engine cylinders. Deactivated refers to operation using less than all of the cylinders of the engine (one or more cylinders not active).

Referring now to FIG. 1, a vehicle 10 includes an engine 12 that drives a transmission 14. The transmission 14 is either an automatic or a manual transmission that is driven by the engine 12 through a corresponding torque converter or clutch 16. Air flows into the engine 12 through a throttle 13 and is combusted with fuel therein. The engine 12 includes N cylinders 18. One or more of the cylinders 18 are selectively deactivated during engine operation. Although FIG. 1 depicts eight cylinders (N=8), it can be appreciated that the engine 12 may include additional or fewer cylinders 18. For example, engines having 4, 5, 6, 8, 10, 12 and 16 cylinders are contemplated. Air flows into the engine 12 through an intake manifold 20 and is combusted with fuel in the cylinders 18. Accessories 22 such as a hydraulic pump, HVAC compressor, and/or alternator are driven by the engine 12.

A controller 24 communicates with the engine 12 and various sensors discussed herein. A transmission sensor 26 generates a gear signal based on a current operating gear of the transmission 14. An engine speed sensor 28 generates a signal based on engine speed. An engine oil temperature sensor 30 generates a signal based on engine temperature. An intake manifold temperature sensor 32 generates a signal based on intake manifold temperature. An intake manifold pressure sensor 34 generates a signal based on a vacuum pressure of the intake manifold 20. An intake air temperature sensor 40 generates a signal based on intake air temperature. A throttle position sensor (TPS) 42 generates a signal based on throttle position. An accelerator pedal position sensor (APPS) 43 generates a signal based on accelerator pedal position.

When light engine load occurs, the controller 24 transitions the engine 12 to the deactivated mode. In an exemplary embodiment, N/2 cylinders 18 are deactivated, although one or more cylinders may be deactivated. Upon deactivation of the selected cylinders 18, the controller 24 increases the power output of the remaining cylinders 18. The controller 24 provides DOD transition control using torque-based moding as will be described below.

Figure 2:
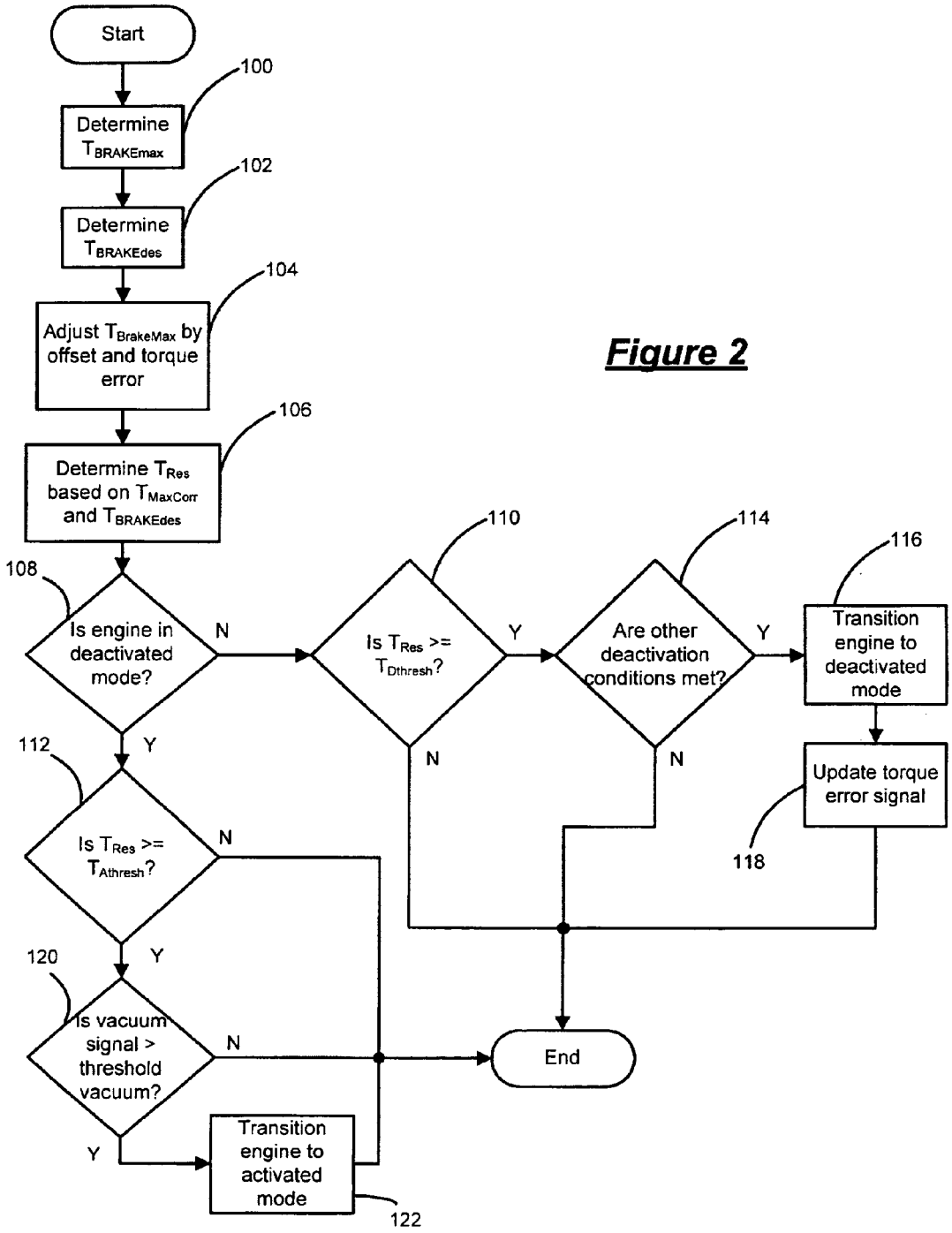
FIG. 2 is a flowchart illustrating steps performed by the DOD transition control system according to the present invention.

Referring now to FIG. 2, steps of a DOD transition control method according to the present invention are shown. In step 100, control determines a maximum available brake torque in deactivated mode ($T_{BRAKEmaxDeac}$) from the engine 12. $T_{BRAKEmax}$ is based on atmospheric conditions, the engine speed signal, estimated losses resulting from friction and pumping, inlet charge dilution, and tables or equations of engine efficiency. Atmospheric conditions are based on a barometer signal generated by a barometer 44 and the intake air temperature signal. Pumping losses are estimated based on the vacuum signal and the engine speed signal. Friction losses are estimated based on an engine oil temperature signal and the engine speed signal. Inlet charge dilution is based on exhaust gas re-circulation and camshaft phase.

In step 102, control determines a desired brake torque ($T_{BRAKEdes}$). $T_{BRAKEdes}$ is calculated based on accelerator pedal position, engine speed, estimated friction and pumping losses, and estimated accessory loads. Accelerator pedal position is determined based on the accelerator pedal position sensor signal. In step 104, control corrects $T_{BRAKEmaxDeact}$ by a stored learned busyness offset and a learned torque error to provide a corrected maximum brake torque ($T_{MAXCorrDeac}$). The learned torque error is based on the engine speed signal, theoretical vacuum and the vacuum signal. More particularly, the controller 24 determines a theoretical vacuum based on $T_{BRAKEdes}$, engine speed, atmospheric conditions, dilution and estimated friction and pumping losses, and makes a comparison to the actual engine vacuum immediately after transitioning to the deactivated mode.

The controller 24 uses transfer function equations or tables to convert the vacuum error into a learned torque error. The learned torque error may be a single value or a table of values based on engine speed and load. The stored learned busyness offset is updated when the system is determined to be busy or not busy based on the time between transitions and may be a single value or a table of values based on engine speed.

In step 106, a torque reserve ($T_{Res}$) is determined based on a difference between $T_{MAXCorrDeac}$ and $T_{BRAKEdes}$. $T_{Res}$ is the amount of torque available beyond the current engine torque output at the current operating conditions when the engine 12 is throttled. In step 108, control determines whether the engine 12 is currently in the deactivated mode. If false, control continues with step 110. If true, control continues with step 112.

In step 110, control determines whether $T_{Res}$ is greater than a deactivation threshold torque ($T_{Dthresh}$). The deactivation threshold is determined from a look-up table based on engine speed and transmission gear. If $T_{Res}$ is not greater than $T_{Dthresh}$, there is insufficient brake torque available to support the transition to deactivated mode while maintaining the minimum reserve torque, and control ends. Otherwise, there is sufficient brake torque available and control continues in step 114.

In step 114, control determines whether other transition conditions are met. These conditions include engine speed, transmission gear, oil pressure, oil temperature, coolant temperature, brake booster vacuum, battery voltage, and/or sensor (e.g. MAP, MAF, TPS, oil temperature) malfunction. It will be appreciated that the transition conditions provided herein are merely exemplary and not exhaustive of all possible deactivation mode conditions. If the other transition conditions are not met, control ends. Otherwise, control transitions the engine 12 to the deactivated mode in step 116. In step 118, the torque error is determined as previously described in conjunction with step 104 and updated in memory.

In step 112, control determines whether $T_{Res}$ is less than an activation threshold torque ($T_{Athresh}$). The activation threshold is determined from a look-up table that is accessed using engine speed and transmission gear. If $T_{Res}$ is less than $T_{Athresh}$, there is insufficient brake torque available to remain in deactivated mode and control continues to step 122. Otherwise, there is sufficient brake torque available and control continues with step 120.

In step 120, control compares the vacuum signal to a threshold vacuum value to determine whether engine vacuum is insufficient to remain in deactivated mode. The vacuum threshold value can be determined from a look-up table based on engine speed and transmission gear or using other methods. If the vacuum signal is less than the threshold vacuum, there is insufficient vacuum to remain in deactivated mode and control continues to step 122. In step 122, control transitions to activated mode. Otherwise, there is sufficient vacuum and control ends.

The DOD transition control system of the present invention reduces the occurrence of undesired mode transitions or cycling and compensates for engine to engine variations and engine aging. Additionally, the DOD transition control system compensates for changing atmospheric conditions and enables faster transitions from the deactivated to activated modes.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine control system for controlling transitions between activated and deactivated modes in a displacement on demand engine, comprising:

an engine speed sensor that generates an engine speed signal; and a controller that calculates a torque reserve of said engine based on said engine speed signal, that transitions said engine from said activated mode to said deactivated mode when said torque reserve is greater than a threshold torque, and that transitions said engine from said deactivated mode to said activated mode when said torque reserve is lower than said threshold torque.

2. The engine control system of claim 1 wherein said controller determines available and desired brake torques.

3. The engine control system of claim 2 wherein said torque reserve is based on a difference between said available brake torque in deactivated mode and said desired brake torque.

4. The engine control system of claim 2 wherein said available brake torque in deactivated mode is based on atmospheric conditions, engine speed, estimated pumping losses of said engine, estimated friction losses, and inlet charge dilution of said engine.

5. The engine control system of claim 2 wherein said desired brake torque is based on accelerator pedal position, engine speed, estimated pumping losses of said engine, estimated friction losses, and accessory loads of said engine.

6. The engine control system of claim 1 wherein said controller generates a torque error signal and adjusts said torque reserve based on said torque error signal.

7. The engine control system of claim 6 wherein said torque error signal is based on a difference between a vacuum signal received by said controller and a model vacuum signal determined by said controller.

8. The engine control system of claim 1 wherein said controller transitions from said deactivated mode to said activated mode when said torque reserve is lower than said threshold torque.

9. A method for controlling transitions between activated and deactivated modes in a displacement on demand engine, comprising:

determining a torque reserve of said engine based on an engine speed signal;

comparing said torque reserve to a threshold torque; and transitioning from said activated mode to said deactivated mode when said torque reserve is greater than said threshold torque.

10. The method of claim 9 further comprising transitioning from said deactivated mode to said activated mode when said torque reserve is lower than said threshold torque.

11. The method of claim 9 further comprising:

determining a desired brake torque;

determining an available brake torque in deactivated mode; and determining said torque reserve based on said desired brake torque and said available brake torque.

12. The method of claim 11 wherein said available brake torque in deactivated mode is based on atmospheric conditions, engine speed, estimated pumping losses of said engine, estimated friction losses, inlet charge dilution and one of tables and equations of engine efficiency of said engine.

13. The method of claim 11 wherein said desired brake torque is based on accelerator pedal position, engine speed, estimated pumping losses of said engine, estimated friction losses and accessory loads of said engine.

14. The method of claim 9 further comprising:

determining a torque error signal; and adjusting said torque reserve based on said torque error signal.

15. The method of claim 14 wherein said torque error signal is based on a vacuum signal and a model vacuum signal.

16. The method of claim 10 further comprising:

generating a vacuum signal of said engine; and transitioning from said deactivated mode to said activated mode when said torque reserve is one of lower than said threshold torque and said vacuum signal is less than a threshold vacuum signal.

17. A method for controlling transitions between activated and deactivated modes in a displacement on demand engine, comprising:

determining a torque reserve of said engine;

comparing said torque reserve to a threshold torque;

determining a torque error signal;

adjusting said torque reserve based on said torque error signal;

transitioning from said activated mode to said deactivated mode when said torque reserve is greater than said threshold torque; and transitioning from said deactivated mode to said activated mode when said torque reserve is lower than said threshold torque.

18. The method of claim 17 further comprising:

determining a desired brake torque;

determining an available brake torque in deactivated mode; and determining said torque reserve based on said desired brake torque and said available brake torque.

19. The method of claim 18 wherein said available brake torque is based on atmospheric conditions, engine speed, estimated pumping losses of said engine, estimated friction losses of said engine and accessory loads of said engine.

20. The method of claim 18 wherein said desired brake torque is based on accelerator pedal position, engine speed, estimated pumping losses of said engine, estimated friction losses and inlet charge dilution of said engine.

21. The method of claim 17 wherein said torque error signal is based on a vacuum signal and a model vacuum signal.

22. The method of claim 17 further comprising:

generating a vacuum signal;

transitioning from said deactivated mode to said activated mode when said torque reserve is one of lower than said threshold torque and said vacuum signal is less than a threshold vacuum signal.

* * * * *